US011721506B2

(12) United States Patent
Azuma et al.

(10) Patent No.: US 11,721,506 B2
(45) Date of Patent: Aug. 8, 2023

(54) ELECTROMAGNETIC DEVICE

(71) Applicant: OMRON Corporation, Kyoto (JP)

(72) Inventors: Yoshihiro Azuma, Takatsuki (JP); Yoshikazu Tajiri, Kikuchi (JP)

(73) Assignee: OMRON CORPORATION, Kyoto (JP)

( * ) Notice: Subject to any disclaimer, the term of this patent is extended or adjusted under 35 U.S.C. 154(b) by 64 days.

(21) Appl. No.: 17/428,444

(22) PCT Filed: Jan. 29, 2020

(86) PCT No.: PCT/JP2020/003118
§ 371 (c)(1),
(2) Date: Aug. 4, 2021

(87) PCT Pub. No.: WO2020/162279
PCT Pub. Date: Aug. 13, 2020

(65) Prior Publication Data

US 2022/0108857 A1 Apr. 7, 2022

(30) Foreign Application Priority Data

Feb. 5, 2019 (JP) ..... 2019-018899

(51) Int. Cl.
*H01H 50/18* (2006.01)
*H01H 47/02* (2006.01)
(Continued)

(52) U.S. Cl.
CPC ..... *H01H 47/02* (2013.01); *H01H 50/18* (2013.01); *H01H 50/36* (2013.01); *H01H 50/44* (2013.01)

(58) Field of Classification Search
CPC ..... H01H 50/18; H01H 50/36
(Continued)

(56) References Cited

U.S. PATENT DOCUMENTS 1,239,357 A * 9/1917 Currier et al. ..... H01H 50/54 335/133
1,481,104 A * 1/1924 Lenaghan ..... H01H 50/26 335/281
(Continued)

FOREIGN PATENT DOCUMENTS

GB 1576493 A 10/1980
JP S5497746 U 7/1979
(Continued)

OTHER PUBLICATIONS

JPO Notice of Reasons for Refusal for corresponding JP Patent Application No. 2019-018899; dated Oct. 5, 2021.
(Continued)

*Primary Examiner* — Alexander Talpalatski
(74) *Attorney, Agent, or Firm* — Cantor Colburn LLP

(57) ABSTRACT

An electromagnetic device includes a spool including a cylindrical body portion in which a through hole extending to a first direction is provided, a coil wound around the body portion, an iron core disposed in a through hole of the body portion, a yoke including a first member and a second member, the first member being connected to the iron core and the second member extending from the first member along an outer peripheral surface of the coil, and a movable iron piece, which has a plate shape, including a bent portion in a middle thereof. The yoke includes at least one positioning projection provided in a middle of the free end in the second direction. The movable iron piece includes a positioning recessed portion that accommodates and positions the positioning projection, the positioning recessed portion being provided in a middle between the pair of rotation supporting points.

4 Claims, 6 Drawing Sheets

(51) Int. Cl.
*H01H 50/36* (2006.01)
*H01H 50/44* (2006.01)

(58) Field of Classification Search
USPC ..... 335/128, 78
See application file for complete search history.

(56) References Cited

U.S. PATENT DOCUMENTS 1,577,031 A * 3/1926 Kaisling ..... H01H 50/26 335/276
2,929,001 A * 3/1960 Wallace ..... H01H 63/02 335/274
4,670,727 A * 6/1987 Muller ..... H01H 50/28 335/274
7,205,870 B2 * 4/2007 Sanada ..... H01H 50/642 335/83
7,372,350 B2 * 5/2008 Chida ..... H01H 50/546 335/78
7,439,834 B2 * 10/2008 Mochizuki ..... H01H 50/041 335/78
7,932,795 B2 * 4/2011 Kozai ..... H01H 50/642 335/78
2017/0301496 A1 10/2017 Hayashida et al.

FOREIGN PATENT DOCUMENTS

JP S5551810 U 4/1980
JP S62143335 A 6/1987
JP H0511411 U 2/1993
JP 200123472 A 1/2001
JP 2003217419 A 7/2003
WO 2016088403 A1 6/2016

OTHER PUBLICATIONS

EPO Extended European Search Report for corresponding EP Application No. 20752897.7; dated Sep. 30, 2022.
International Search Report for International Application No. PCT/JP2020/003118; dated Jul. 4, 2020.
Written Opinion of the International Search Authority for International Application No. PCT/JP2020/003118; dated Jul. 4, 2020.
JPO Notice of Reasons for Refusal for corresponding JP Application No. 2019-018899; dated Jan. 25, 2022.

* cited by examiner

ELECTROMAGNETIC DEVICE

CROSS REFERENCE TO RELATED APPLICATIONS

This is the U.S. national stage of application No. PCT/JP2020/003118, filed on Jan. 29, 2020. Priority under 35 U.S.C. § 119(a) and 35 U.S.C. § 365(b) is claimed from Japanese Application No. 2019-018899, filed Feb. 5, 2019, the disclosure of which is also incorporated herein by reference.

TECHNICAL FIELD

The present disclosure relates to an electromagnetic device to which an alternating current is supplied.

BACKGROUND ART

Patent Literature 1 describes an electromagnetic device of an electromagnetic relay excited by an alternating current. In the electromagnetic device, a notch is provided in a magnetic attracting portion of an iron core to which a movable iron piece is attracted, and a magnetic force per unit area of the magnetic attracting portion is increased. As a result, the movable iron piece is held in the magnetic attracting portion of the iron core in a stable state to prevent generation of a growling sound.

CITATION LIST

Patent Literature

PTL 1 JP H05-11411 U

SUMMARY OF INVENTION

Technical Problem

In the electromagnetic device, for example, when the iron core is inclined, the magnetic attracting portion is also inclined. For this reason, when the movable iron piece is attracted to the magnetic attracting portion of the iron core, a gap is generated in a part between the movable iron piece and the magnetic attracting portion, an attracted state of the movable iron piece to the iron core becomes unstable, and generation of a growling sound may not be reliably prevented.

An object of the present disclosure is to provide an electromagnetic device to which an alternating current is supplied, which is capable of more reliably preventing generation of a growling sound.

Solution to Problem

According to an example of the present disclosure, there is provided an electromagnetic device to which an alternating current is supplied, the electromagnetic device including:

a spool including a cylindrical body portion in which a through hole extending in a first direction is provided;

a coil, through which the alternating current flows, wound around the body portion in the first direction;

an iron core including an attracting portion provided at a first end thereof in the first direction, the iron core being disposed in the through hole of the body portion and having both ends in the first direction exposed to an outside of the spool;

a yoke, which has a plate shape, including a first member and a second member, the first member being connected to a second end of the iron core in the first direction, and the second member extending from the first member along an outer peripheral surface of the coil toward the attracting portion of the iron core; and a movable iron piece, which has a plate shape, including a bent portion in a middle thereof and an attracted portion which is attracted to the attracting portion of the iron core when the coil is excited, the attracted portion being rotatably disposed at a free end on the attracting portion side of the second member of the yoke via a pair of rotation supporting points provided at both ends of the bent portion in a second direction intersecting the first direction and a thickness direction of the second member, wherein the yoke includes at least one positioning projection provided in a middle of the free end of the second member in the second direction, the positioning projection extending in the first direction and in a direction away from the first member, and the movable iron piece includes a positioning recessed portion that accommodates and positions the positioning projection, the positioning recessed portion being provided in a middle between the pair of rotation supporting points of the bent portion.

Advantageous Effects of Invention

According to the electromagnetic device, the yoke includes at least one positioning projection provided in the middle of the free end of the second member, and the movable iron piece includes the positioning recessed portion that accommodates and positions the positioning projection, the positioning recessed portion being provided in the middle between the pair of rotation supporting points of the bent portion. With such a configuration, the distance between the pair of rotation supporting points of the movable iron piece can be increased, so that generation of a growling sound can be more reliably prevented.

DESCRIPTION OF EMBODIMENTS

Hereinafter, an example of the present disclosure will be described with reference to the accompanying drawings. In the following description, terms indicating specific directions or positions (for example, terms including "up," "down," "right," and "left") are used as necessary, but the use of these terms is to facilitate understanding of the present disclosure with reference to the drawings, and the technical scope of the present disclosure is not limited by the meanings of these terms. Further, the following description is merely exemplary in nature and is not intended to limit the present disclosure, an object for application, or a usage. Furthermore, the drawings are schematic, and ratios of dimensions and the like do not necessarily match actual ones.

Figure 1:
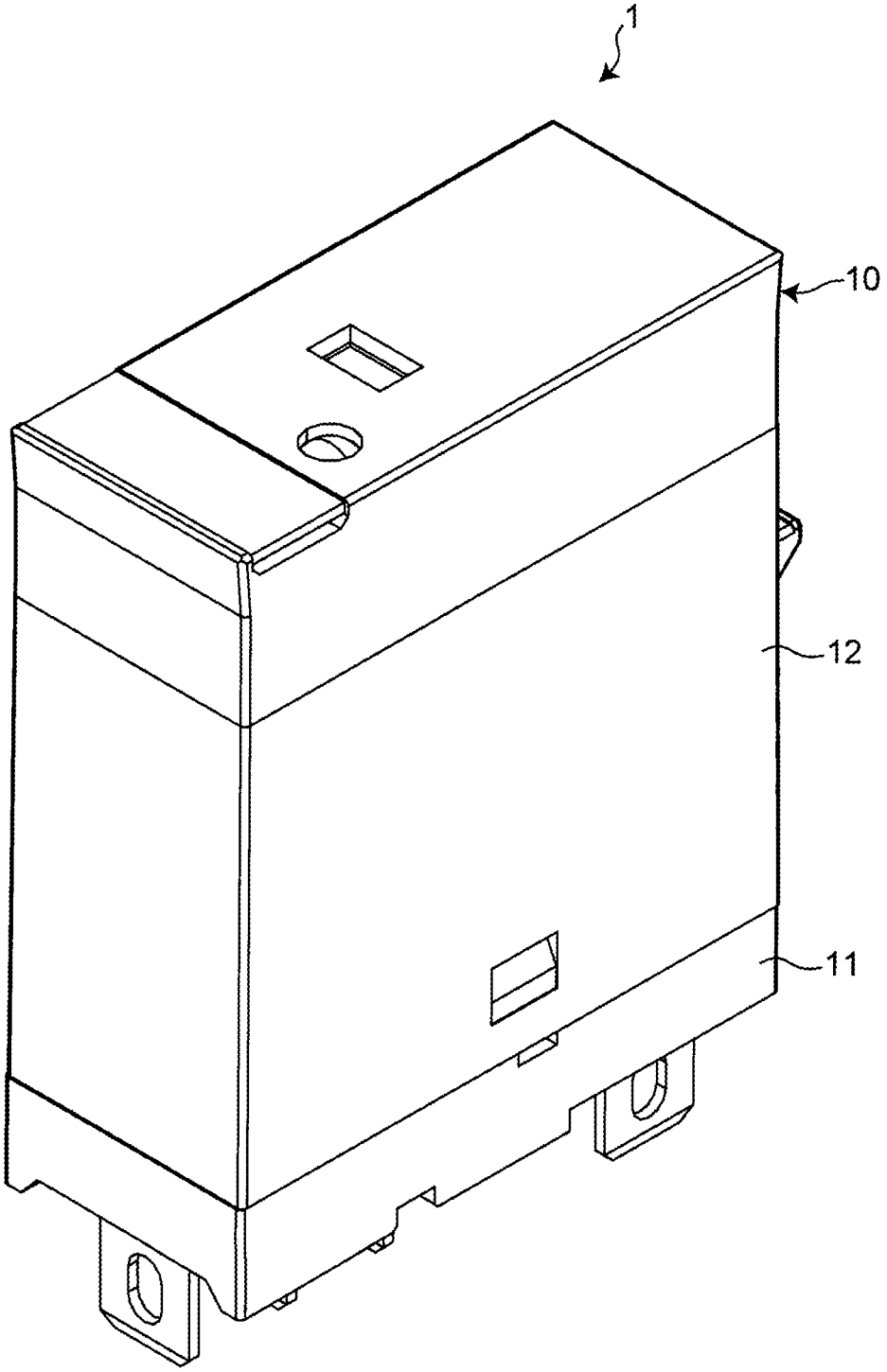
FIG. 1 is a perspective view of an electromagnetic relay including an electromagnetic device according to an embodiment of the present disclosure.
Figure 2:
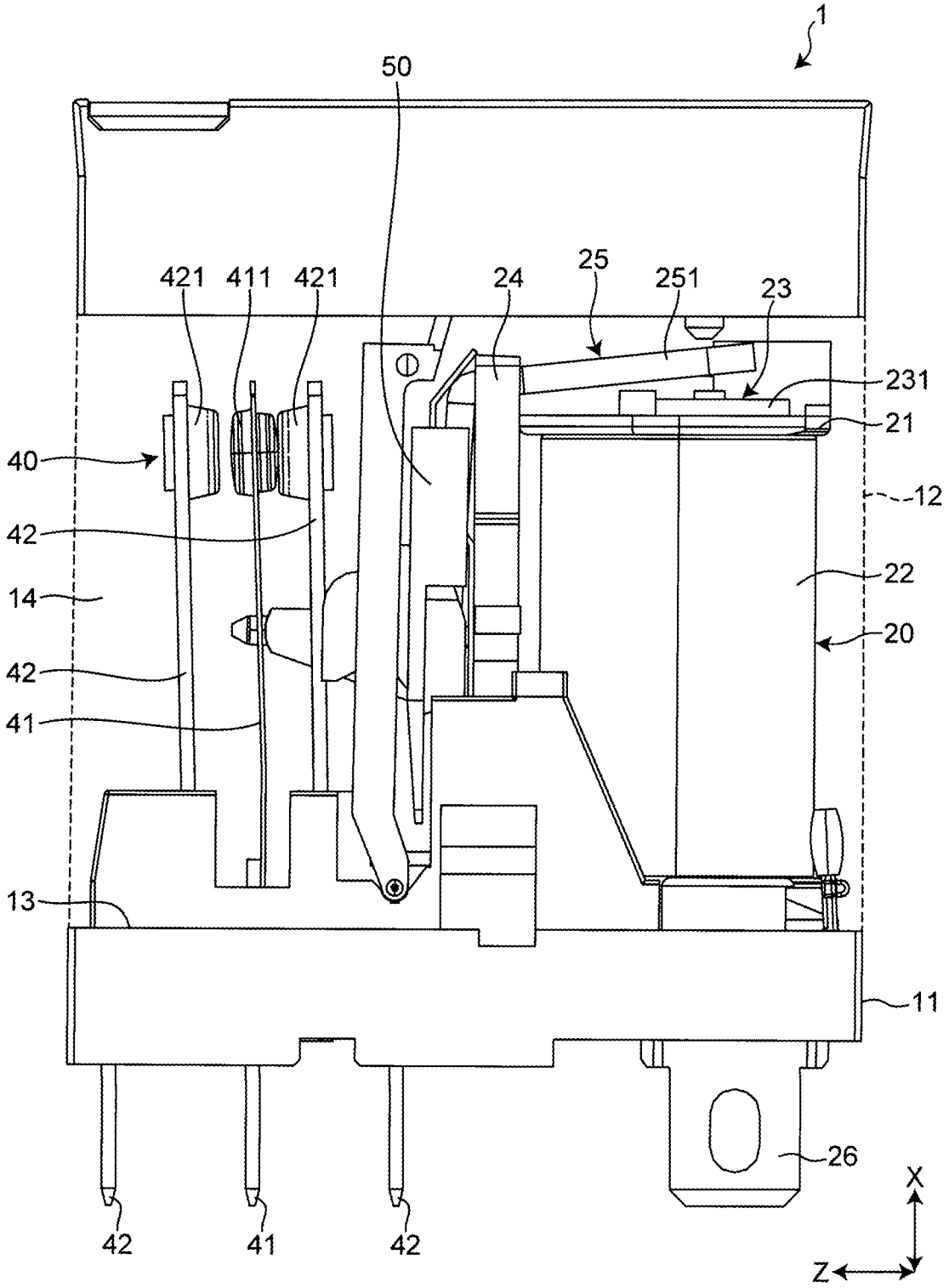
FIG. 2 is a side view of a state in which a part of a cover of the electromagnetic relay of FIG. 1 is removed.

As illustrated in FIG. 1, an electromagnetic relay 1 including an electromagnetic device 20 according to an embodiment of the present disclosure includes a housing 10, which has a substantially rectangular shape, including a base 11 and a case 12. As illustrated in FIG. 2, the base 11 has a substantially rectangular plate shape, and one surface in a thickness direction thereof constitutes an installation surface 13. The case 12 has a substantially rectangular box shape, and is attached to the base 11 so as to cover the installation surface 13 of the base 11. Inside the housing 10, an accommodating portion 14 constituted by the installation surface 13 of the base 11 and the case 12 is provided.

As illustrated in FIG. 2, the accommodating portion 14 accommodates the electromagnetic device 20 and a contact mechanism portion 40, which are fixed to the installation surface 13 of the base 11.

Figure 3:
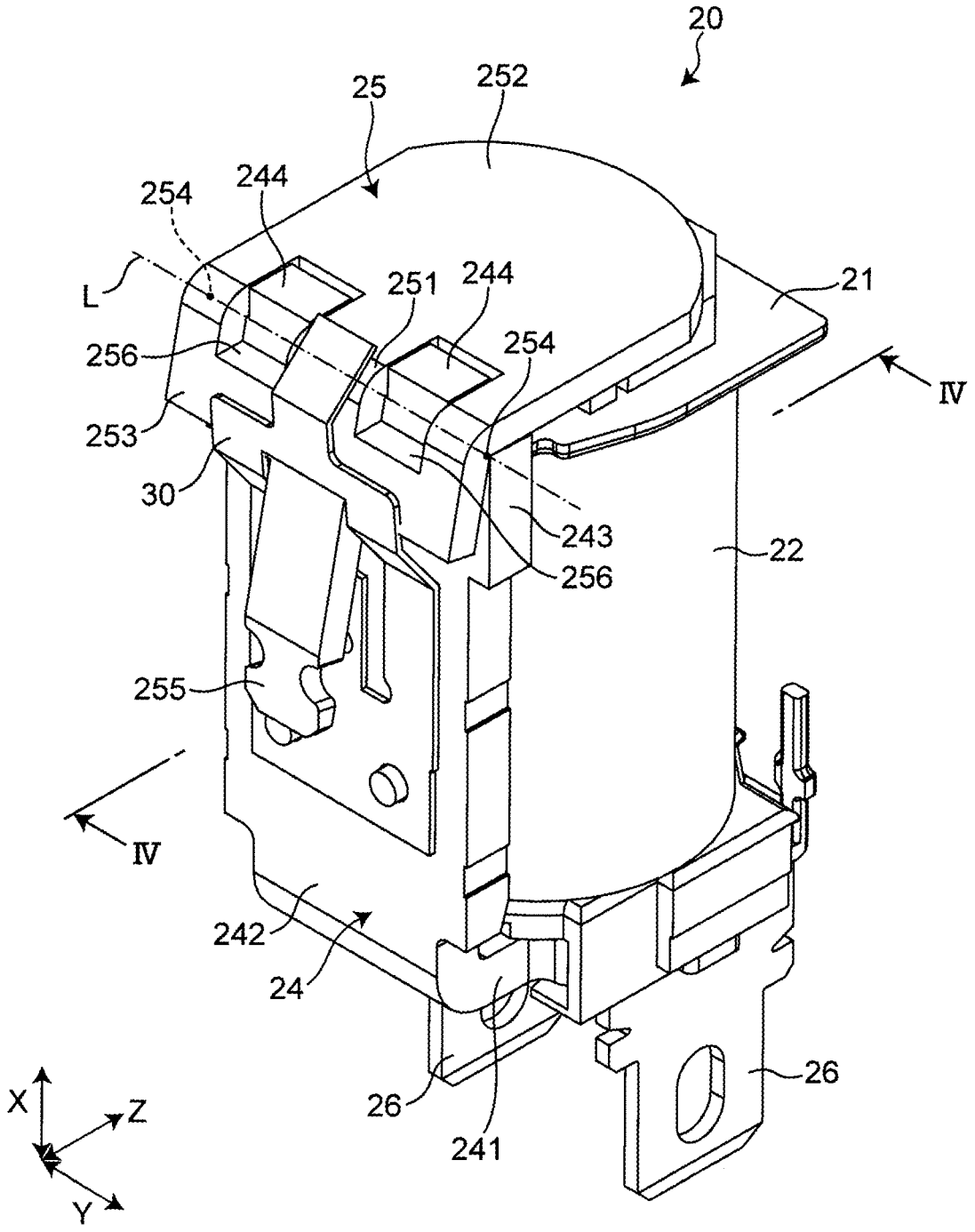
FIG. 3 is a perspective view of the electromagnetic device according to the embodiment of the present disclosure.
Figure 4:
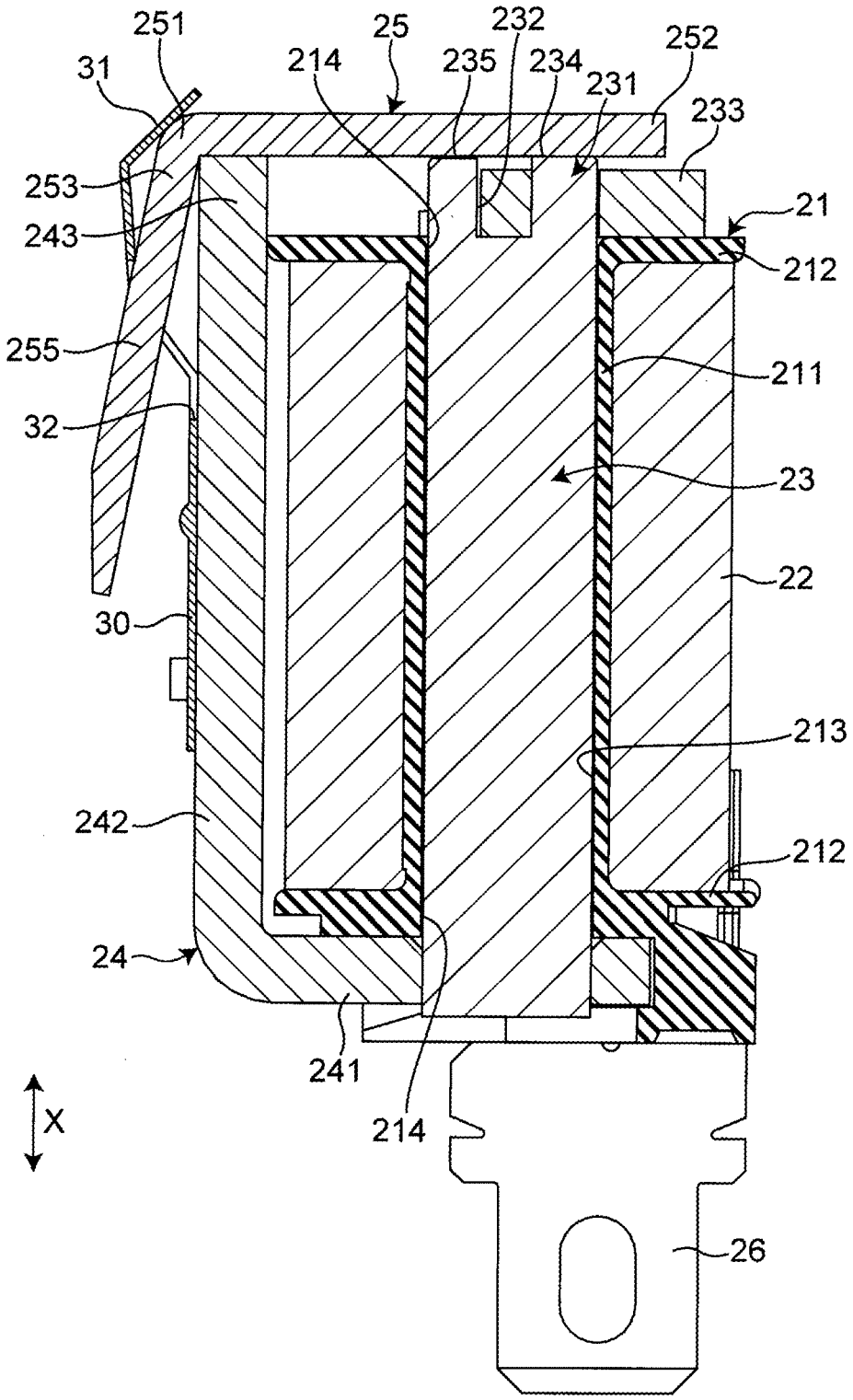
FIG. 4 is a cross-sectional view taken along the line IV-IV of FIG. 3.

As illustrated in FIGS. 3 and 4, the electromagnetic device 20 includes an insulating spool 21, a coil 22 wound around the spool 21, an iron core 23 (illustrated only in FIG. 4) disposed inside the spool 21, a yoke 24 having one end connected to the iron core 23, and a movable iron piece 25 rotatably disposed at the other end of the yoke 24. In the present embodiment, the yoke 24 and the movable iron piece 25 are connected via a leaf spring 30.

As illustrated in FIG. 4, the spool 21 includes a cylindrical body portion 211 extending in a first direction X intersecting (for example, orthogonal to) the installation surface 13, and two flange portions 212 provided at both ends of the body portion 211 in the first direction X, respectively. As an example, the body portion 211 has a substantially cylindrical shape, and has a through hole 213 extending in the first direction X therein. Both ends of the through hole 213 are connected to the respective flange portions 212. That is, each flange portion 212 is provided with an opening portion 214 connected to the through hole 213.

As illustrated in FIG. 4, the coil 22 is wound around the body portion 211 of the spool 21 in the first direction X. A coil terminal 26 is electrically connected to the coil 22. An alternating current is supplied to the coil 22 via the coil terminal 26.

As illustrated in FIG. 4, the iron core 23 has, for example, a substantially cylindrical shape and is disposed in the through hole 213 of the body portion 211 of the spool 21. Both ends of the iron core 23 in the first direction X are exposed to the outside of the spool 21. One end (first end) of the iron core 23 in the first direction Xis provided with an attracting portion 231 that attracts an attracted portion 252 of the movable iron piece 25 to be described later. Further, a first member 241 of the yoke 24 to be described later is connected to the other end (second end) of the iron core 23 in the first direction X.

The attracting portion 231 includes a groove 232 provided on one end surface of the iron core 23 in the first direction X, and a shading coil 233 fitted in the groove 232. Among one end surfaces of the iron core 23 in the first direction X, an end surface surrounded by the shading coil 233 around the first direction X is defined as a first attracting surface 234, and an end surface not surrounded by the shading coil 233 around the first direction X is defined as a second attracting surface 235. When an alternating current is supplied to the coil 22, a phase difference is generated between a magnetic flux passing through the first attracting surface 234 and a magnetic flux passing through the second attracting surface 235, and either one of the first attracting surface 234 and the second attracting surface 235 is always magnetized.

As illustrated in FIG. 4, the yoke 24 has, as an example, a substantially rectangular plate shape bent in an L shape, and includes the first member 241 connected to the other end of the iron core 23 in the first direction X, and a second member 242 extending from the first member 241 along the outer peripheral surface of the coil 22 toward the attracting portion 231 of the iron core 23. As illustrated in FIG. 3, at least one (in the present embodiment, two) positioning projection 244 is provided at a free end 243 of the second member 242 (that is, an end of the second member 242 farther from the first member 241 in the first direction X). When a direction intersecting (for example, orthogonal to) the first direction X and a thickness direction Z of the second member 242 is defined as a second direction Y, the positioning projections 244 are provided in a middle of the free end 243 of the second member 242 in the second direction Y, and are disposed at an interval in the second direction Y. Each positioning projection 244 extends in the first direction X and in a direction away from the first member 241.

As illustrated in FIG. 3, as an example, the movable iron piece 25 has a substantially L shape including a bent portion 251 extending in the second direction Y in a middle thereof, and includes the attracted portion 252 extending in the thickness direction Z of the second member 242, and a connecting portion 253 extending in the first direction X. The attracted portion 252 is attracted to the attracting portion 231 of the iron core 23 when an alternating current flows through the coil 22 and is excited. A bar-shaped member 255 to which a movable member 50 (illustrated in FIG. 2) is connected is provided at an end portion of the connecting portion 253 farther from the bent portion 251 in the first direction X and at a center of the connecting portion 253 in the second direction Y. The movable iron piece 25 and the contact mechanism portion 40 are connected via the movable member 50.

The bent portion 251 includes a pair of rotation supporting points 254 provided at both ends of the second member 242. The movable iron piece 25 is rotatably disposed at the free end 243 of the second member 242 of the yoke 24 via each rotation supporting point 254. In other words, the movable iron piece 25 is disposed at the free end 243 of the second member 242 of the yoke 24 so as to be rotatable about a rotation axis L passing through the pair of rotation supporting points 254.

In addition, the bent portion 251 includes a positioning recessed portion 256 that accommodates the positioning projections 244 and positions the positioning projections 244 in the second direction Y, the positioning recessed portion 256 being provided in a middle between the pair of rotation supporting points 254. In the present embodiment, two positioning recessed portions 256 respectively corresponding to the two positioning projections 244 are provided, and each positioning recessed portion 256 is configured as a through hole penetrating the movable iron piece 25 in the plate thickness direction as an example.

Figure 5:
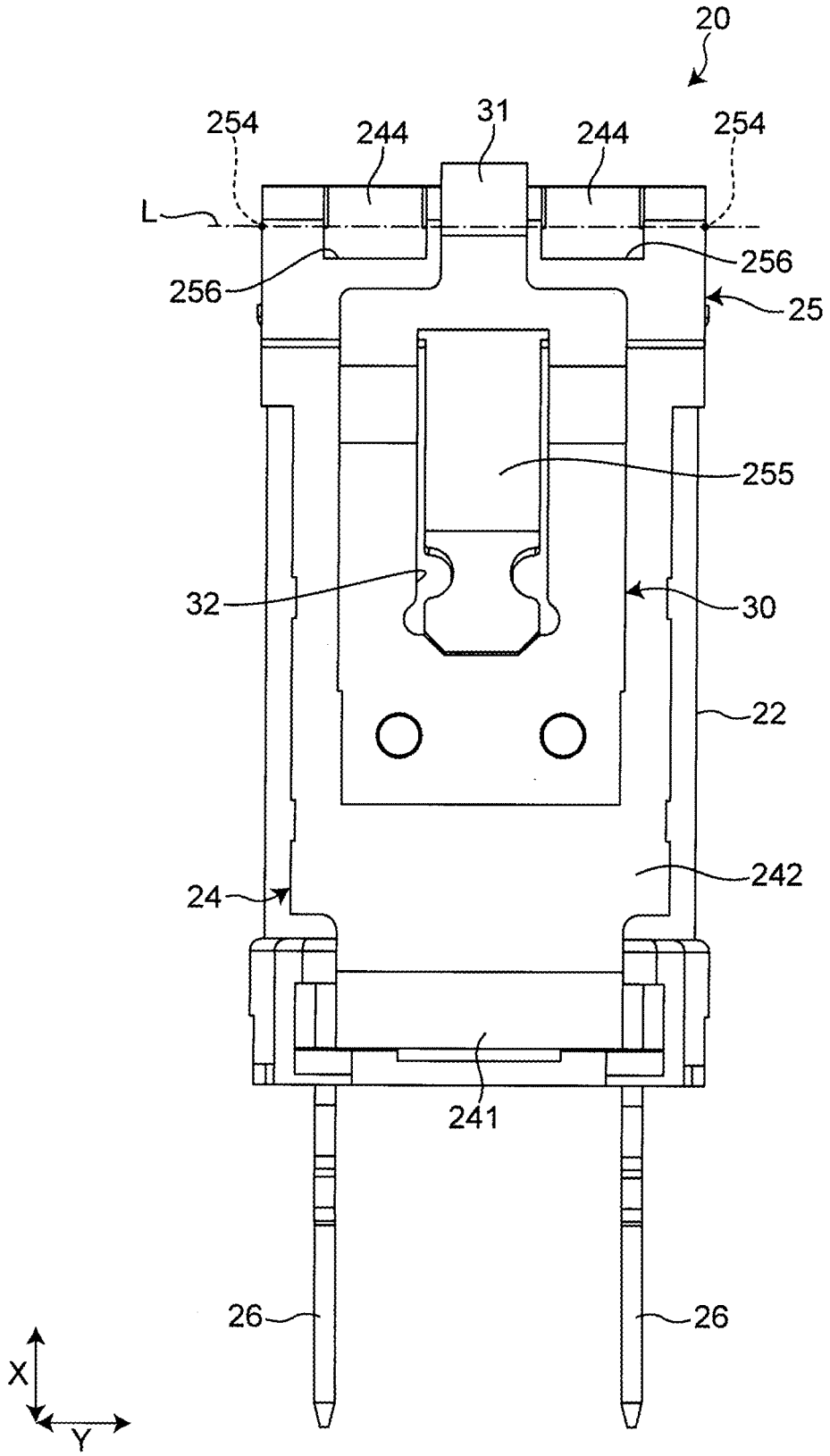
FIG. 5 is a front view of the electromagnetic device of FIG. 3.

As illustrated in FIG. 5, the leaf spring 30 has a substantially rectangular shape extending along the first direction X. An end portion of the leaf spring away from the movable iron piece 25 in the first direction X is fixed to the second member 242 of the yoke 24. The leaf spring 30 includes an urging portion 31 that urges the movable iron piece 25 toward the second member 242 of the yoke 24, and a through hole 32 into which the bar-shaped member 255 of the movable iron piece 25 is inserted and disposed. The urging portion 31 is provided at the end portion of the leaf spring 30 on the movable iron piece 25 side in the first direction X and at a center of the leaf spring 30 in the second direction Y, and is disposed between the two positioning recessed portions 256 of the movable iron piece 25. The urging portion 31 urges the movable iron piece 25 toward the second member 242 of the yoke 24 at one point in the middle between the pair of rotation supporting points 254.

Each of the yoke 24, the movable iron piece 25, and the leaf spring 30 has a symmetrical shape in the second direction Y. That is, the leaf spring 30 urges the movable iron piece 25 toward the second member 242 of the yoke 24 at one point at a center of the pair of rotation supporting points 254 in the second direction Y.

As illustrated in FIG. 2, the contact mechanism portion 40 is disposed adjacent to the electromagnetic device 20 in a longitudinal direction of the base 11 (that is, the thickness direction Z of the second member 242 of the yoke 24). As an example, the contact mechanism portion 40 includes a movable contact side terminal 41 having a substantially rectangular plate shape, and two fixed contact side terminals 42 having a substantially rectangular plate shape and disposed on both sides of the movable contact side terminal 41 in a direction orthogonal to the plate surface. The movable contact side terminal 41 and the fixed contact side terminals 42 each extend from the outside of the accommodating portion 14 to the inside of the accommodating portion 14, and are electrically disposed independently such that the plate surfaces face each other. A movable contact portion 411 is provided at an end portion of the movable contact side terminal 41 on the accommodating portion 14 side, and a fixed contact portion 421 facing the movable contact portion 411 is provided at an end portion of each fixed contact side terminal 42 on the accommodating portion 14 side.

The movable contact side terminal 41 is connected to the bar-shaped member 255 of the movable iron piece 25 of the electromagnetic device 20 via the movable member 50 in the accommodating portion 14. The movable member 50 is configured to drive along the longitudinal direction Z of the base 11 in response to excitation/non-excitation of the electromagnetic device 20 and to bring the movable contact portion 411 into contact with or separate from the fixed contact portion 421.

According to the electromagnetic device 20, the yoke 24 includes at least one positioning projection 244 provided in the middle of the free end 243 of the second member 242, and the movable iron piece 25 includes the positioning recessed portion 256 that accommodates and positions the positioning projection 244, the positioning recessed portion 256 being provided in the middle between the pair of rotation supporting points 254 of the bent portion 251. With such a configuration, a distance between the pair of rotation supporting points 254 of the movable iron piece 25 can be increased. That is, when the attracted portion 252 of the movable iron piece 25 is attracted to the attracting portion 231 of the iron core 23, the triangle with a contact point between the attracted portion 252 of the movable iron piece 25 and the attracting portion 231 of the iron core 23 and the pair of rotation supporting points 254 of the movable iron piece 25 as vertices becomes large, and an attracted state of the movable iron piece 25 to the iron core 23 is stabilized. As a result, even if the iron core 23 is inclined and a gap is generated in a part between the attracting portion 231 of the iron core 23 and the attracted portion 252 of the movable iron piece 25, it is possible to more reliably prevent generation of a growling sound.

The electromagnetic device 20 includes the leaf spring 30 that urges the movable iron piece 25 toward the second member 242 of the yoke 24 at one point in the middle between the pair of rotation supporting points 254 to rotatably connect the movable iron piece 25 to the yoke 24. With such a configuration, the attracted state of the movable iron piece 25 to the iron core 23 can be further stabilized.

The leaf spring 30 urges the movable iron piece 25 toward the second member 242 of the yoke 24 at one point in the center in the second direction Y. With such a configuration, the attracted state of the movable iron piece 25 to the iron core 23 can be more reliably stabilized.

Each of the yoke 24, the movable iron piece 25, and the leaf spring 30 has a symmetrical shape in the second direction. With such a configuration, the attracted state of the movable iron piece 25 to the iron core 23 can be more reliably stabilized.

Figure 6:
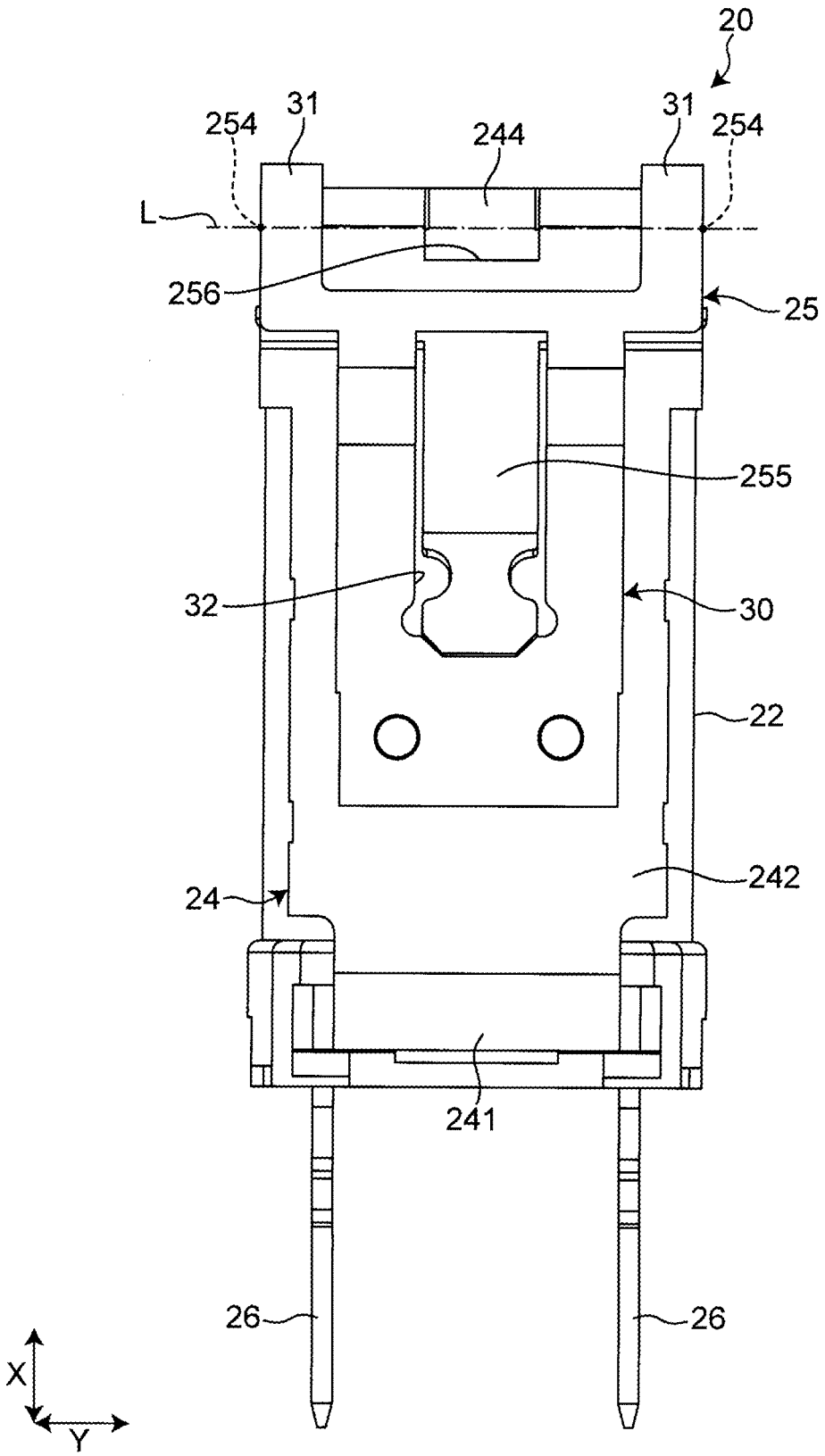
FIG. 6 is a front view illustrating a modification of the electromagnetic device of FIG. 3.

The leaf spring 30 is not limited to the case of urging the movable iron piece 25 toward the second member 242 of the yoke 24 at one point in the middle between the pair of rotation supporting points 254. For example, as illustrated in FIG. 6, the leaf spring 30 may be configured to urge the movable iron piece 25 toward the second member 242 of the yoke 24 at each of the pair of rotation supporting points 254. The leaf spring 30 of FIG. 6 includes two urging portions 31 provided at both end portions of the leaf spring 30 in the second direction Y at the end on the movable iron piece 25 side of the leaf spring 30 in the first direction X. With this configuration, the movable iron piece 25 can be more reliably connected to the second member 242 of the yoke 24. That is, the connection reliability between the yoke 24 and the movable iron piece 25 can be enhanced.

The leaf spring 30 may urge the movable iron piece 25 toward the second member 242 of the yoke 24 at one point in the middle of the pair of rotation supporting points 254, and is not limited to the case of urging the movable iron piece 25 toward the second member 242 of the yoke 24 at one point in the center in the second direction Y.

The number of each of the positioning projections 244 and the positioning recessed portions 256 is not limited to two, and only one may be provided as illustrated in FIG. 6, or three or more may be provided although not illustrated.

Each of the yoke 24, the movable iron piece 25, and the leaf spring 30 is not limited to have a symmetrical shape in the second direction Y, and may have an asymmetrical shape in the second direction Y.

Various embodiments of the present disclosure have been described above in detail with reference to the drawings. Finally, various aspects of the present disclosure will be described. In the following description, as an example, reference numerals are also added.

According to a first aspect of the present disclosure, there is provided an electromagnetic device 20 to which an alternating current is supplied, the electromagnetic device 20 including:

a spool 21 including a cylindrical body portion 211 in which a through hole 213 extending in a first direction X is provided;

a coil 22, through which the alternating current flows, wound around the first direction X of the body portion 211;

an iron core 23 including an attracting portion 231 provided at a first end thereof in the first direction X, the iron core 23 being disposed in the through hole 213 of the body portion 211 and having both ends in the first direction X exposed to an outside of the spool 21;

a yoke 24, which has a plate shape, including a first member 241 and a second member 242, the first member 241 being connected to a second end of the iron core 23 in the first direction X, and the second member 242 extending from the first member 241 along an outer peripheral surface of the coil 22 toward the attracting portion 231 of the iron core 23; and a movable iron piece 25, which has a plate shape, includes a bent portion 251 in a middle thereof and an attracted portion 252 which is attracted to the attracting portion 231 of the iron core 23 when the coil is excited, the attracted portion 252 being rotatably disposed at a free end 243 on the attracting portion 231 side of the second member 242 of the yoke 24 via a pair of rotation supporting points 254 provided at both ends of the bent portion 251 in a second direction Y intersecting the first direction X and a thickness direction Z of the second member 242, wherein the yoke 24 includes at least one positioning projection 244 provided in a middle of the free end 243 of the second member 242 in the second direction Y, the positioning projection 244 extending in the first direction X and in a direction away from the first member 241, and the movable iron piece 25 includes a positioning recessed portion 256 that accommodates and positions the positioning projection 244, the positioning recessed portion 256 being provided in a middle between the pair of rotation supporting points 254 of the bent portion 251.

According to the electromagnetic device 20 of the first aspect, the yoke 24 includes at least one positioning projection 244 provided in the middle of the free end 243 of the second member 242, and the movable iron piece 25 includes the positioning recessed portion 256 that accommodates and positions the positioning projection 244, the positioning recessed portion 256 being provided in the middle between the pair of rotation supporting points 254 of the bent portion 251. With such a configuration, the distance between the pair of rotation supporting points 254 of the movable iron piece 25 can be increased, so that generation of a growling sound can be more reliably prevented.

The electromagnetic device 20 of a second aspect of the present disclosure further includes a leaf spring 30 that urges the movable iron piece 25 toward the second member 242 of the yoke 24 at one point in a middle between the pair of rotation supporting points 254 to rotatably connect the movable iron piece 25 to the yoke 24.

According to the electromagnetic device 20 of the second aspect, the attracted state of the movable iron piece 25 to the iron core 23 can be further stabilized.

In the electromagnetic device 20 of a third aspect of the present disclosure, the leaf spring 30 urges the movable iron piece 25 toward the second member 242 of the yoke 24 at one point in a center in the second direction Y.

According to the electromagnetic device 20 of the third aspect, the attracted state of the movable iron piece 25 to the iron core 23 can be more reliably stabilized.

The electromagnetic device 20 of a fourth aspect of the present disclosure further includes a leaf spring 30 that urges the movable iron piece 25 toward the second member 242 of the yoke 24 at each of the pair of rotation supporting points 254 to rotatably connect the movable iron piece 25 to the yoke 24.

According to the electromagnetic device 20 of the fourth aspect, the movable iron piece 25 can be more reliably connected to the second member 242 of the yoke 24. That is, the connection reliability between the yoke 24 and the movable iron piece 25 can be enhanced.

In the electromagnetic device 20 of a fifth aspect of the present disclosure, each of the yoke 24, the movable iron piece 25, and the leaf spring 30 has a symmetrical shape in the second direction Y.

According to the electromagnetic device 20 of the fifth aspect, the attracted state of the movable iron piece 25 to the iron core 23 can be more reliably stabilized.

By appropriately combining any embodiments or modifications among the various embodiments or modifications, the effects of the respective embodiments or modifications can be achieved. In addition, combinations of embodiments, combinations of examples, or combinations of embodiments and examples are possible, and combinations of features in different embodiments or examples are also possible.

Although the present disclosure has been fully described in connection with preferred embodiments with reference to the accompanying drawings, various modifications and corrections will be apparent to those skilled in the art. Such modifications and corrections are to be understood as being included within the scope of the present disclosure as set forth in the appended claims.

INDUSTRIAL APPLICABILITY

The electromagnetic device of the present disclosure can be applied to, for example, an electromagnetic relay.

REFERENCE SIGNS LIST

1. electromagnetic relay
10. housing
11. base
12. case
13. installation surface
14. accommodating portion
20. electromagnetic device
21. spool
211. body portion
212. flange portion
213. through hole
214. opening portion
22. coil
23. iron core
231. attracting portion
232. groove
233. shading coil
234. first attracting surface
235. second attracting surface
24. yoke
241. first member
242. second member
243. free end
244. positioning projection
25. movable iron piece
251. bent portion
252. attracted portion
253. connecting portion
254. rotation supporting point
255. bar-shaped member
256. positioning recessed portion
26. coil terminal
30. leaf spring
31. urging portion
32. through hole
40. contact mechanism portion

41. movable contact side terminal
411. movable contact portion
42. fixed contact side terminal
421. fixed contact portion
50. movable member

The invention claimed is:

1. An electromagnetic device to which an alternating current is supplied, comprising:

a spool including a cylindrical body portion in which a first through hole extending in a first direction is provided;

a coil configured that the alternating current flows through, the coil being wound around the body portion in the first direction;

an iron core including an attracting portion provided at a first end thereof in the first direction, the iron core being disposed in the first through hole of the body portion and having both ends in the first direction exposed to an outside of the spool;

a yoke, which has a plate shape, including a first member and a second member, the first member being connected to a second end of the iron core in the first direction, and the second member extending from the first member along an outer peripheral surface of the coil toward the attracting portion of the iron core; and a movable iron piece, which has a plate shape, including a bent portion in a middle thereof and an attracted portion which is attracted to the attracting portion of the iron core when the coil is excited, the attracted portion being rotatably disposed at a free end on the attracting portion side of the second member of the yoke via a pair of rotation supporting points provided at both ends of the bent portion in a second direction intersecting the first direction and a thickness direction of the second member, wherein the yoke includes at least one positioning projection provided in a middle of the free end of the second member in the second direction, the positioning projection extending in the first direction and in a direction away from the first member, the movable iron piece includes a positioning recessed portion that accommodates and positions the positioning projection, the positioning recessed portion being provided in a middle between the pair of rotation supporting points of the bent portion, the electromagnetic device comprises:

a leaf spring that urges the movable iron piece toward the second member of the yoke at one point in a middle between the pair of rotation supporting points to rotatably connect the movable iron piece to the yoke, the movable iron piece includes:

the attracted portion extending from the bent portion in the thickness direction of the second member;

a connecting portion extending from the bent portion in the first direction; and a bar-shaped member provided at an end portion of the connecting portion farther from the bent portion in the first direction and at a center of the connecting portion in the second direction, and the leaf spring includes a second through hole into which the bar-shaped member of the movable iron piece is disposed.

2. The electromagnetic device according to claim 1, wherein the leaf spring urges the movable iron piece toward the second member of the yoke at one point in a center in the second direction.

3. The electromagnetic device according to claim 1, wherein each of the yoke, the movable iron piece, and the leaf spring has a symmetrical shape in the second direction.

4. The electromagnetic device according to claim 2, wherein each of the yoke, the movable iron piece, and the leaf spring has a symmetrical shape in the second direction.

* * * * *